US005864074A

United States Patent [19]

Hill

[11] Patent Number: 5,864,074

[45] Date of Patent: Jan. 26, 1999

[54] TREMOLO EFFECT UNIT

[76] Inventor: James Hill, 53 Dufferin Avenue, Bangor, County Down, Northern Ireland

[21] Appl. No.: 728,349

[22] Filed: Oct. 9, 1996

[30] Foreign Application Priority Data

Oct. 10, 1995 [GB] United Kingdom ..... 9520723
May 28, 1996 [GB] United Kingdom ..... 9611084

[51] Int. Cl.[6] ..... G10D 3/00
[52] U.S. Cl. ..... 84/313
[58] Field of Search ..... 84/298, 313

[56] References Cited

U.S. PATENT DOCUMENTS

| | | | |
|---|---|---|---|
| 4,632,005 | 12/1986 | Steinberger | 84/313 |
| 4,643,070 | 2/1987 | Petrillo | 84/313 |
| 4,681,011 | 7/1987 | Hoshino | 84/313 |
| 4,892,025 | 1/1990 | Steinberger | 84/313 |
| 4,941,384 | 7/1990 | Jager | 84/313 |
| 4,955,275 | 9/1990 | Gunn | 84/313 |
| 5,092,214 | 3/1992 | Flynn | 84/312 |
| 5,373,769 | 12/1994 | Sherman | 84/313 |
| 5,381,716 | 1/1995 | May et al. | 84/313 |
| 5,413,019 | 5/1995 | Blanda, Jr. | 84/313 |
| 5,419,227 | 5/1995 | Lavineway | 84/313 |
| 5,435,219 | 7/1995 | Huff | 84/313 |
| 5,551,329 | 9/1996 | Iovane | 84/313 |

FOREIGN PATENT DOCUMENTS 2 235 807 3/1991 United Kingdom .

*Primary Examiner*—William M. Shoop, Jr.
*Assistant Examiner*—Jeffrey W. Donels
*Attorney, Agent, or Firm*—Lahive & Cockfield, LLP

[57] ABSTRACT

A tremelo effect unit and a stringed instrument incorporating a tremelo effect unit include a pivotal support which, in use, secures at least one string of a stringed instrument under tension. The tremelo effect unit can include a resilient biassing element, typically in the form of a compression spring, which pivotally urges the support against the tension of the string. The resilient biassing element is arranged to act in a direction substantially opposite to a direction in which the instrument string extends.

9 Claims, 4 Drawing Sheets

TREMOLO EFFECT UNIT

Applicant claims the right of priority and benefit of earlier filing date under 35 USC §119, based on (i) UK Patent Application No. 9520723.9, filed Oct. 10, 1995 and (ii) UK Patent Application No. 9611084.6, filed May 28, 1996.

The present invention relates to a tremolo effect unit for a stringed instrument, for example, an electric guitar and to a stringed instrument incorporating such a tremolo effect unit.

SUMMARY

According to a first aspect of the invention there is provided a tremolo effect unit comprising a pivotable support adapted, in use, to secure at least one string of a stringed instrument under tension; and resilient biasing means adapted to pivotably urge the support against the tension of the string, the resilient biasing means being arranged in a direction substantially opposite to a direction in which the string extends.

Preferably, the support includes a second bracket adapted and arranged for pivotable movement relative to a first bracket; and an anchor for securing at least one string of the stringed instrument under tension.

More preferably, the second bracket is substantially "L-shaped" and a spacing means is provided, extending between the second bracket and the anchor.

Even more preferably, the first bracket is substantially "L-shaped".

Still more preferably, the first bracket is fixed to the stringed instrument.

Advantageously, the resilient biasing means extends between the first and second brackets and is arranged to urge the first and second brackets apart.

More advantageously, the resilient biasing means comprises at least one compression spring.

Preferably, the spacing means comprises a sleeve terminating in a lip so that, when the tremolo effect unit is mounted in a stringed instrument, the sleeve projects out of the stringed instrument and the sleeve-facing surface of the lip engages a groove provided in the stringed instrument.

More preferably, the opening-adjacent side of the groove is substantially concave in cross-section.

Alternatively, the sleeve-facing surface of the lip is chamfered.

Preferably, the sleeve-facing surface of the lip is substantially convex in cross-section.

Alternatively, the support is adapted for pivotable movement relative to the stringed instrument.

Preferably, the stringed instrument is provided with a tapered opening adapted and arranged to receive the support and to permit pivotable movement of the support relative to the opening of the stringed instrument.

Alternatively, the sleeve of the spacing means is tapered, so as to permit pivotable movement of the support relative to the stringed instrument.

Preferably, a stop member is provided to restrict pivotable movement of the support against the tension of the string.

According to a second aspect of the invention there is provided a stringed instrument incorporating a tremolo effect unit according to a first aspect of the invention.

DESCRIPTION OF THE DRAWINGS

Three embodiments of the invention will now be described, by way of example, with reference to the accompanying drawings, in which.

In the drawings, similar numerals have been given to like parts.

DETAILED DESCRIPTION

Figure 1:
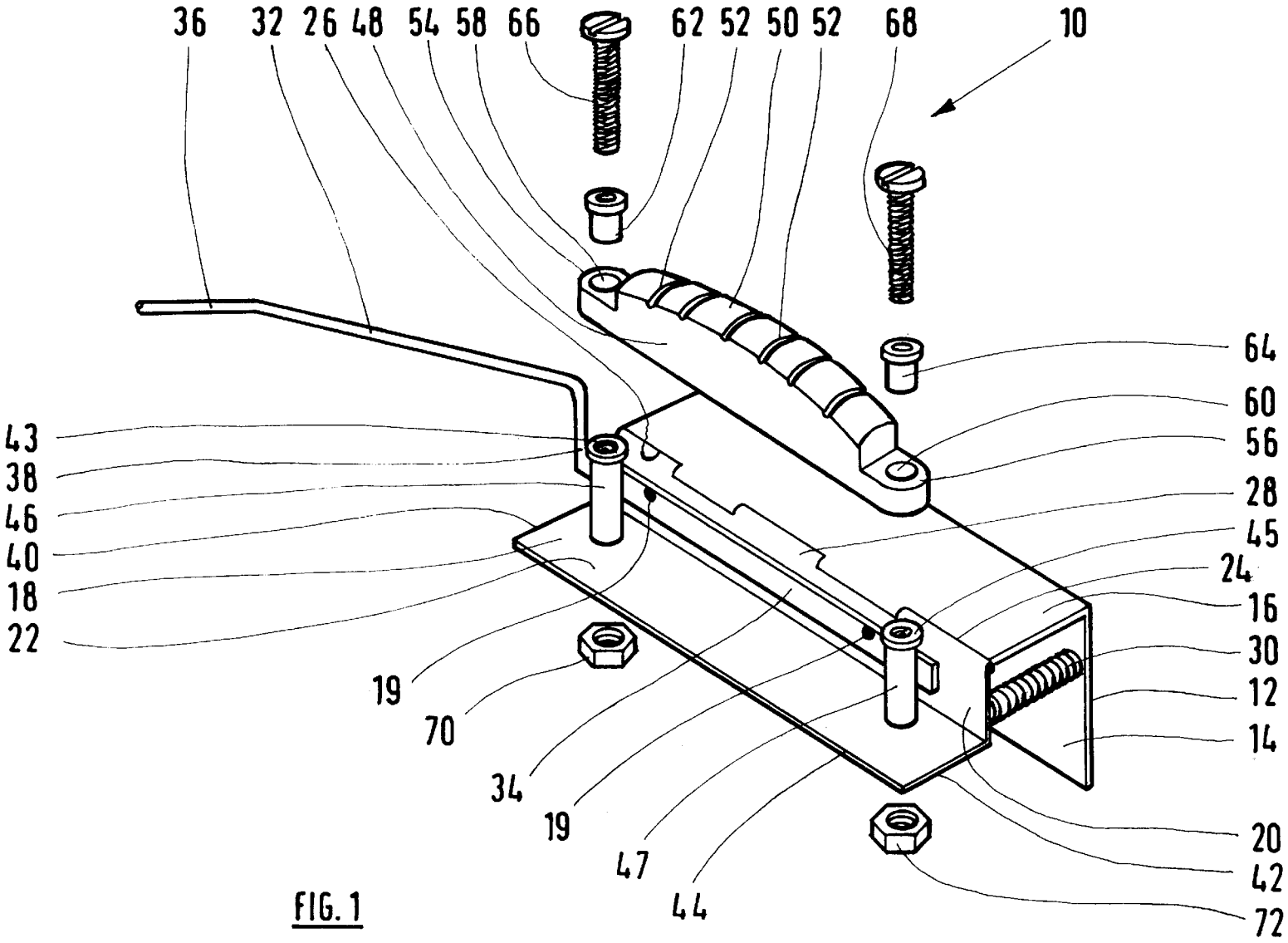
FIG. 1 is an exploded perspective view of a first embodiment of a tremolo effect unit according to the invention.

Referring now to FIG. 1 of the drawings, there is shown a first embodiment of a tremolo effect unit generally indicated at 10 according to the invention. The tremolo effect unit 10 includes a first bracket 12 consisting of a first backplate 14 and a top plate 16. The first backplate 14 and the top plate 16 are joined so that the bracket 12 has a substantially L-shaped cross-section.

The tremolo effect unit 10 also includes a second bracket 18, which is substantially similar to the bracket 12, and has a second backplate 20 and a bottom plate 22. An edge 24 of the top plate 16 and an edge 26 of the backplate 20 are formed as complementary members of a hinge 28. The brackets 12, 18 are thus joined and are pivotable relative to one another.

Resilient biassing means, in the form of a plurality of compression springs 30 (only one visible), are fixed between the second backplate 20 and the first backplate 14. The springs 30 are disposed substantially perpendicular to the plane of the first backplate 14 when unextended. The springs 30 are so dimensioned that they are in at least a partially compressed state when the second backplate 20 is in a plane substantially parallel to that of the first backplate 14.

A lever 32 is fixed to the bracket 18 by, for example, a pair of screws 19. The lever 32 comprises a substantially rectangular bar 34 and an arm 36 projecting from one end 38 of the bar 34. The bar 34 is fixed to the backplate 20 and runs along at least part of the length of the backplate 20, substantially parallel to the hinge 28. The lever 32 is arranged so that in use the arm 36 projects upwards and obliquely away from the top plate 16. It will be appreciated that there are alternative conventional methods of providing a lever on the tremolo effect unit, which methods serve to pivot the second bracket 18 when operated. For example, the lever arm may be mounted directly on and be operable on an anchor 48 (not shown).

A pair of holes (not visible) are formed in the bottom plate 22. One hole is located adjacent an end 40 of the bottom plate 22 and the other hole is located adjacent an opposite end 42 of the bottom plate 22. The centres of the holes are arranged in a line substantially parallel to the longitudinal axis of the hinge 28. The lines joining the centers of the holes is also substantially parallel to an edge 44 of the bottom plate 22.

The tremolo effect unit 10 is provided with two spacing means although the tremolo effect unit could operate with any number of spacing means. Each spacing means comprises a sleeve 46, 47 terminating with a lip 43, 45. In the present embodiment, the sleeve 46, 47 is substantially cylindrical and the lip 43, 45 is annular although it will be appreciated that the sleeve 46, 47 and the lip 43, 45 may be of any suitable shape. One cylindrical sleeve 46, 47 is located over each of the holes. Each sleeve 46, 47 is arranged with its axis coincident with that of its respective hole and substantially perpendicular to the plane of the bottom plate 22. Each annular lip 43, 45 is formed around the terminal or free end of each of the sleeves 46, 47 respectively.

By way of example, the brackets 12, 18, the sleeves 46, 47 and the lips 43, 45 can be formed from stainless steel. A conventional string anchor 48 is substantially oblong in shape and has a convex upper surface 50. A plurality of grooves 52 traverse the upper surface 50 substantially perpendicular to the main axis of the anchor 48. In use, the guitar strings (not shown in FIG. 1) are seated and secured within the grooves 52 in conventional manner.

Each end 54, 56 of the anchor 48 is provided with a hole 58, 60 respectively. Each hole 58, 60 enables communication between the upper surface 50 and the under surface (not visible) of the anchor 48.

The anchor 48 is, in use, located above the sleeves 46, 47 so that the axis of the holes 58, 60 coincide with the axis of the sleeves 46, 47 respectively. A cylindrical washer 62, 64 is seated within each of the holes 58, 60 respectively.

The anchor 48 and the sleeves 46, 47 are arranged so that, in use, two screws 66, 68 can be fed through the washers 62, 64 respectively, the holes 58, 60 respectively and the sleeves 46, 47 respectively until they protrude through the holes formed in the bottom plate 22. The protruding ends (not visible) of the screws 66, 68 are securable by a nut 70, 72 respectively.

Figure 2:
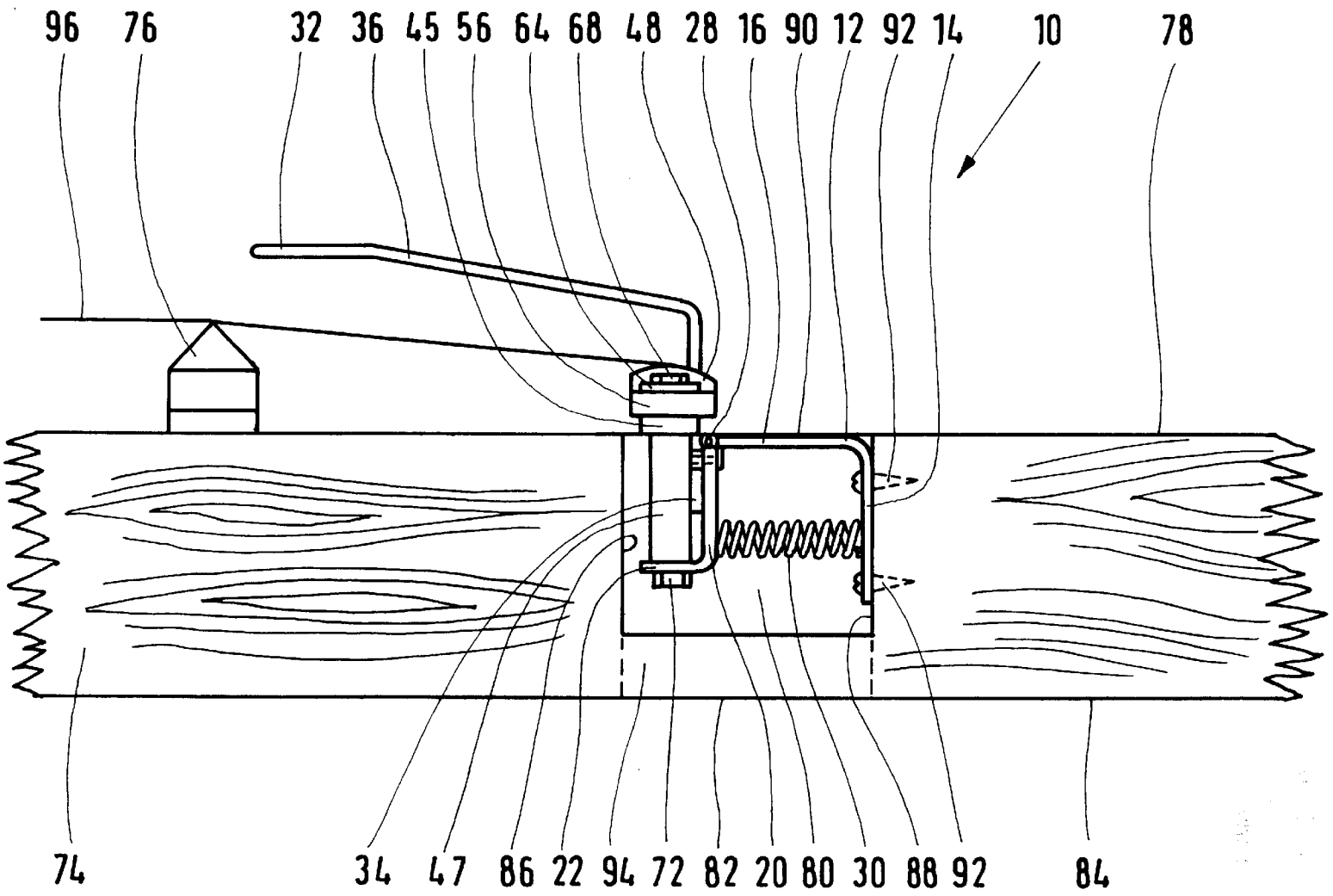
FIG. 2 is a side view of the tremolo effect unit of FIG. 1 in situ in a stringed instrument.

Referring now to FIG. 2 there is shown a side view of the tremolo effect unit, generally indicated at 10. The tremolo effect unit 10 is shown in situ within a body 74 of a stringed instrument in the form of a guitar. A conventional bridge 76 is mounted on the upper surface 78 of the body 74. A substantially rectangular cavity 80 is formed in the body 74 rearwardly of the bridge 76. The mouth 82 of the cavity 80 is located in the underside 84 of the body 74. The cavity 80 has a forward wall 86 and a rearward wall 88.

The walls 86, 88 are disposed in substantially parallel planes which are substantially perpendicular to those of the upper surface 78 and the underside 84 of the body 74. The cavity 80 has a roof 90 which runs substantially parallel to and adjacent the upper surface 78.

The backplate 14 of the bracket 12 is fixed, for example with screws 92, to the rearward wall 88 of the cavity 80. It will be appreciated that the bracket 12 may be fixed in place using adhesive or in any other conventional manner. The bracket 12 is arranged so that the top plate 16 is adjacent the roof 90.

An opening (not visible) is provided between the upper surface 78 and the cavity 80 and is adapted to receive the sleeve 47 and the sleeve 46 (not visible in FIG. 2). The sleeves 46, 47 are fed through the opening from the cavity 80 and positioned as described for FIG. 1. In this position the lips 43, 45 remain outside of the cavity 80. The opening is further adapted to allow the arm 36 of the lever 32 to project out of the cavity 80 through the roof 90.

The anchor 48 and the washers 62, 64 are positioned over the sleeves 46, 47 respectively and secured relative to the bottom plate 22 with the screws 66, 68 and the nuts 70, 72 respectively as described for FIG. 1.

A substantially rectangular block 94 is used to fill the mouth 82 once the tremolo effect unit 10 has been mounted within the cavity 80.

In use, a plurality of strings 96 (only one visible) are anchored and seated within the grooves 52 (one string 96 per groove 52). The strings 96 extend away from the anchor 48, the second bracket 18, over the bridge 76 and are secured to a plurality of string tensioners (not shown), located at the head (not shown) of the guitar, in conventional manner.

The lever 32 is shaped so that the arm 36 projects out of the cavity 80 in a plane substantially perpendicular to the upper surface 78 of the body 74 and so that subsequently the main extent of the arm 36 extends substantially parallel with, but spaced apart from, the strings 96 above the upper surface 78. In addition, the main extent of the arm 36 extends obliquely relative to the strings 96.

The tension in each string 96 is adjusted using the appropriate string tensioner (not shown). Altering the tension in the strings 96 causes the bracket 18 to pivot about the hinge 28 until the tension in the strings 96 is matched by the tension in the springs 30.

In the equilibrium position of the tremolo effect unit 10, the tension in the springs 30 is counter-balanced by the tension in the strings 96 after they have been tuned to the desired pitch or tone for normal usage.

Strings 96 obtained from different manufacturers are not necessarily of the same gauge and, accordingly, the tension in the tuned strings 96 is dependent on the gauge of the strings 96. In order that a suitable equilibrium position is obtainable irrespective of the gauge of the strings 96, it is desirable that the tension in the springs 30 be adjustable. This can be achieved by, for example, providing a nut (not shown in FIGS. 1–3) threaded on each spring retainer 229 (FIG. 4). The nut and its operation are described in connection with FIG. 4.

To operate the tremolo effect unit 10, the arm 36 of the lever 32 is pivoted either towards or away from the upper surface 78 of the body 74 after a string 96 has been plucked. Movement of the arm 36 towards the surface 78 causes the second bracket 18 to pivot in an anti-clockwise direction (as viewed in FIG. 2), thereby decreasing the tension in the strings 96 which lowers the pitch or tone of the sound produced by the plucked string 96. Conversely, pivotable movement of the arm 36 away from the surface 78 causes the second bracket 18 to pivot in a clockwise direction (as viewed in FIG. 2) thus increasing the tension in the strings 96 and raising the pitch or tone of the sound produced by the plucked string 96.

On release of the arm 36, the tremolo effect unit 10 automatically returns to the equilibrium position either under the influence of the springs 30 if the arm 36 had been moved towards the surface 78 or, alternatively, under the influence of the strings 96 if the arm 36 had been moved away from the surface 78.

The extent to which the lever 32 may be moved towards or away from the upper surface 78 depends, inter alia, on the ability of each annular lip 43, 45 to tilt or pivot relative to the upper surface 78 of the body 74. In FIG. 2 a groove (not shown) is formed in the upper surface 78 around each annular lip 43, 45, which groove enables the respective annular lip 43, 45 to tilt relative to the upper surface 78. It is preferred that the opening-adjacent side of the groove be substantially concave in cross-section. This facilitates the tilting motion of the annular lips 43, 45 in response to the lever 32. Alternatively, if no groove is provided, the opening or openings should be dimensioned, and the distance between the upper surface 78 and the sleeve-facing surface of the lips 43, 45 be arranged to permit pivotable movement of bracket 18/spacing means 43, 45, 46, 47 relative to the stringed instrument.

Figure 3:
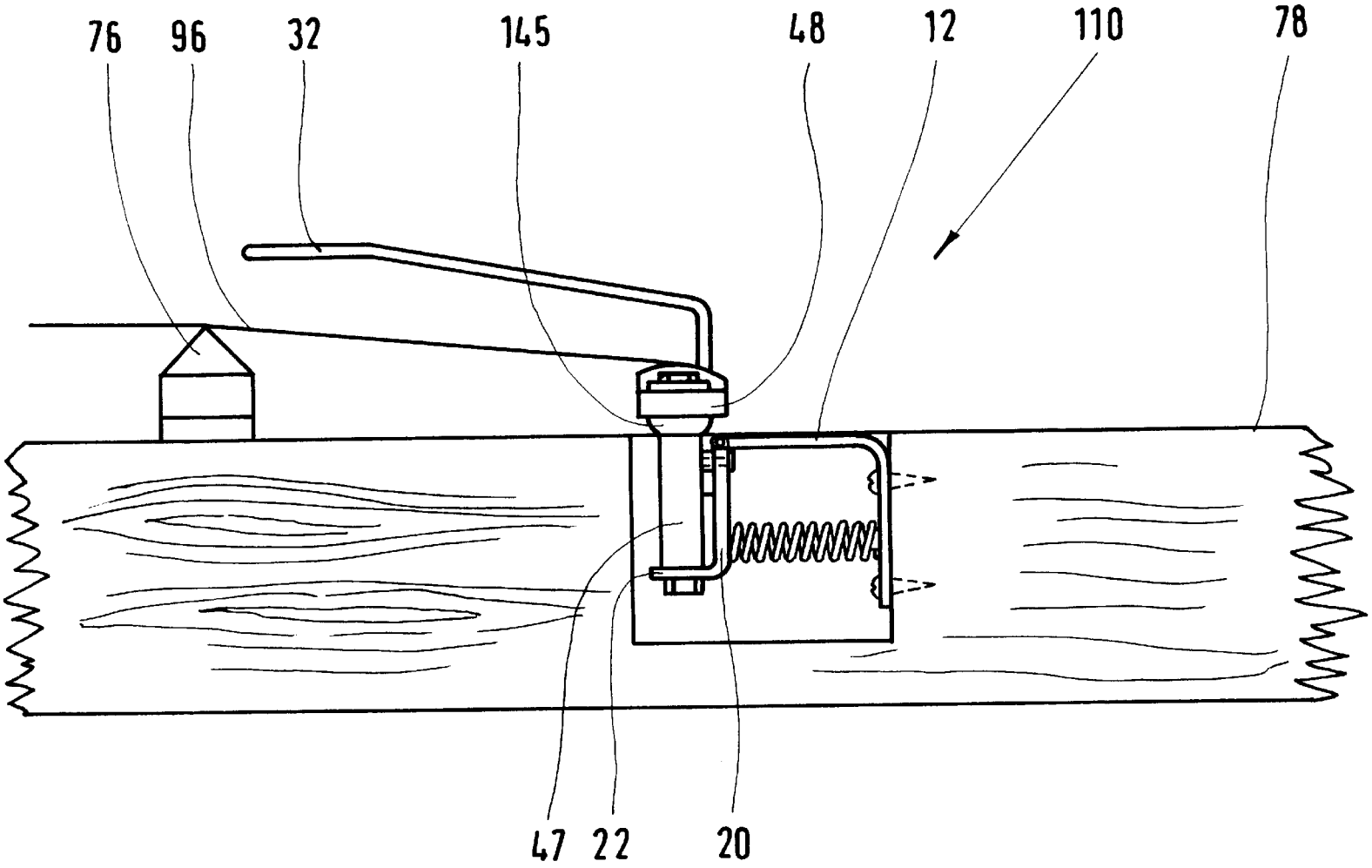
FIG. 3 is a side view of a second embodiment of a tremolo effect unit having spacing means with an arcuate or convex lip.
Figure 4:
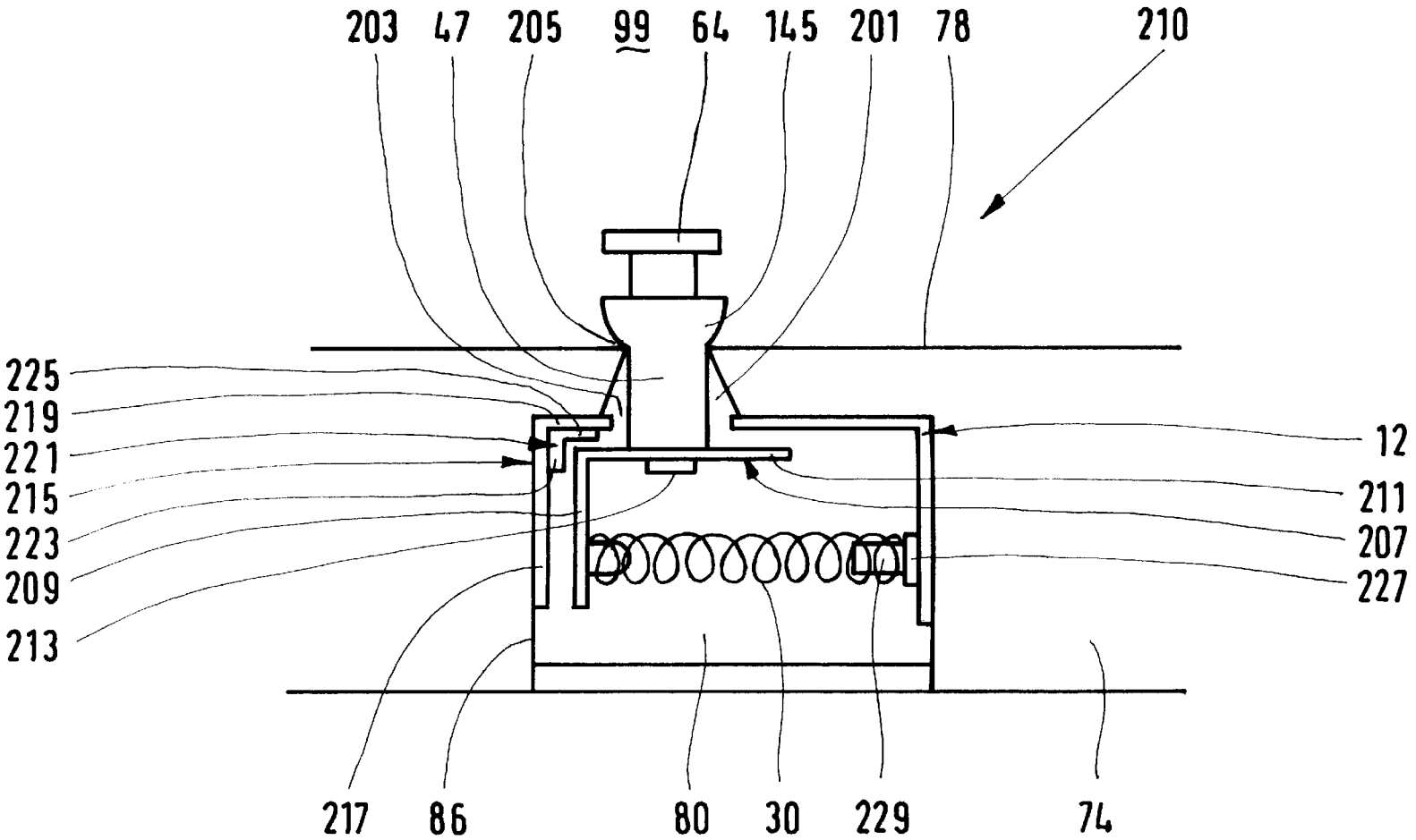
FIG. 4 is a side view of a third embodiment of a tremolo effect unit in situ in a stringed instrument, in which the string and lever have been omitted for clarity.

FIG. 3 shows a side view of another embodiment of the tremolo effect unit 110, in situ, in which each annular lip 143, 145 (only 145 shown) has a substantially convex instrument-engaging or sleeve-facing surface. The at least partially rounded surface (hereinafter referred to as the rounded or convex surface) enables each annular lip 143, 145 to pivot anticlockwise or clockwise (as viewed in FIG. 3) against the upper surface 78 as the lever 32 is moved towards or away from the surface 78 respectively.

The rounded annular lip 143, 145 facilitates the operation of the tremolo effect unit 110. In particular, for a given exertion on the lever 32, the rounded annular lip 143, 145 enables the lever 32 to move further than the flat or non-rounded annular lip 43, 45 (FIG. 2) allows and, in addition, avoids modification of the stringed instrument itself. Furthermore, the travel of the lever 32 is increased by the use of the rounded annular lip 143, 145. Thus, the extent to which the tremolo effect unit 110 can lower or raise the pitch or tone of a sound is increased.

It will be appreciated that the stringed instrument may, in addition, be modified to incorporate a groove, having a chamfered or concave opening-adjacent side. This would further increase the extent to which the tremolo effect unit 110 can raise or lower the pitch or tone of a plucked string.

Referring now to FIG. 4 of the drawings, there is shown a third embodiment of a tremolo effect unit 210 according to the present invention. In this embodiment, the cavity 80 communicates with the surrounding environment 99 via a pair of tapered openings 201 (only one visible). Each opening 201 has a widened mouth 203 into the cavity 80 and a narrowed mouth 205 onto the environment 99.

The sleeves 46, 47 (only 47 shown) are located within a respective opening 201 so that the rounded annular lips 143, 145 (only 145 shown) are seated on the respective narrowed mouth 205. In this position the annular lips 143, 145 are able to rock or pivot against the upper surface 78, as described for the embodiment of FIG. 3.

A support in the form of a second bracket or plate 207, of substantially L-shaped cross-section, comprises a front plate 209 and a top plate 211. The top plate 211 is secured to the sleeves 46, 47 using a pair of bolts (not shown) and nuts 213 (only one visible) so that the top plate 211 is perpendicularly disposed with respect to the sleeves 46, 47.

A first bracket 215, of substantially L-shaped cross-section, comprises a front plate 217 and a top plate 219. The front plate 217 is secured to the forward wall 86 of the cavity 80 so that the top plate 219 is located against the roof 90 of the cavity 80. The top plate 219 projects into the widened mouth 203, as does the top plate 16.

A stop member 221, of substantially L-shaped cross-section, has a front portion 223 and a top portion 225. The stop member 221 is secured to the bracket 215 so that the top portion 225 is located against the top plate 219 and the front portion 223 is located against the front plate 217. It may be desirable to provide such a stop member in the first and second embodiments 10, 110 and, if so used, this would limit the degree to which the support could pivot against the tension of the strings (not shown).

A nut 227 (only one shown) is threaded onto each spring retainer 229 (only one shown). The tension in the springs 30 is thus adjustable by screwing each nut 227 back and forth along the respective retainer 229.

In the equilibrium position, as illustrated in FIG. 4, the bracket 207 is spaced-apart from the stop member 221.

The tremolo effect unit 210 operates in a similar manner to that described for the tremolo effect units 10, 110. Movement of the lever arm (not shown) towards the surface 78 of the body 74 causes the bracket 207 to pivot anti-clockwise (as viewed in FIG. 4) against the bias of the springs 30. In the equilibrium position, movement of the lever arm away from the body 74 causes the bracket 207 to pivot clockwise (as viewed in FIG. 4) towards the stop member 221. Hence, the extent to which the lever arm can be moved away from the body 74 is limited by the resilience of the stop member 221 and the distance between the bracket 207 and the stop member 221. The stop member 221 may, for example, be formed from nylon (Trade Mark) or a similar material.

It will be appreciated that, in the present embodiment, the support or pivoting assembly of the tremolo effect unit 210, which pivoting assembly includes the sleeves 46, 47, the annular lips 143, 145 and the plate 207, is not fixedly secured to the body 74. Rather, the annular lips 143, 145 of the pivoting assembly rest on the periphery of the respective narrowed mouth 205 and prevent downward movement of the annular lips 143, 145 as viewed in FIG. 4. The stop member 221 limits both upward movement of the top plate 211 and anti-clockwise movement of the plate 207, as viewed in FIG. 4. In addition, the projections of the top plate 219 and the top plate 16 into the widened mouth 203 serve to limit the pivoting movement of the pivoting assembly. This arrangement is advantageous in that the tremolo effect unit 210 is lighter and more responsive to the action of an operator (not shown) than a tremolo effect unit of the first and second embodiments which employ a mechanical hinge or the like.

In addition, the pivoting assembly of the tremolo effect unit 210 can pivot further relative to the body 74 than a mechanically hinged assembly since the pivoting movement is not restricted by the mechanical limitations of the hinge. Therefore, the pitch or tone of a sound produced by a plucked string can be altered to a greater extent than can be achieved by a mechanically hinged assembly. Furthermore, a mechanical hinge or mechanical pivot structure usually accounts for a significant proportion of the material costs of a tremolo effect unit. The tremolo effect unit 210 is, therefore, significantly cheaper to produce.

It will be appreciated that the extent to which the pivoting assembly pivots relative to the body 74 in response to a particular force applied to the lever 30 is dependent, inter alia, on the distance between the fulcrum of the pivoting action (the hinge 28 or the mouth 205) and the location at which the lever 30 is connected to the pivoting assembly. It is advantageous to arrange for said distance to be as great as possible to improve the response of the tremolo effect unit 10, 110, 210.

It will be appreciated that the present invention provides a tremolo effect unit 10, 110, 210 which is located within the body of the stringed instrument rearwardly of the strings and independent of the position of the instrument's bridge. The precise location may therefore be selected to suit an individual's needs. Furthermore, the springs 30, which are located behind and extend rearwardly from the string anchor 48, may, in addition, be located behind and extend rearwardly from the bridge 76. An electric guitar includes at least one electromagnetic coil or 'pick-up' (not shown) mounted substantially within the body 74 in front of the bridge 76. In a tremolo effect unit 10, 110, 210 according to the present invention, the springs 30, which are usually formed at least partially from ferromagnetic material, extend in a direction which is substantially away from the electromagnetic coils or 'pick-ups' and do not, therefore, interfere with their operation.

Conventionally, the electromagnetic coils or 'pick-ups' are housed within at least one cavity (not shown) formed in the upper surface 78 of the body 74 in front of the bridge 76. The tremolo effect unit 10, 110, 210 as described above does not require that an additional cavity for the tremolo effect unit be made beneath the cavity formed for the 'pick-ups' and so avoids further weakening of the body 74 of the stringed instrument at this position.

The weight of the tremolo effect unit 10, 110, 210 is substantially equal to that of the wood (not shown) removed from the body 74 to form the cavity 80. Hence, the tremolo effect system 10, 110, 210 does not upset the balance of the stringed instrument in which it is mounted.

I claim:

1. A tremolo effect unit for a stringed instrument, said stringed instrument having a body, a head, a bridge fixed to a first surface of the body and at least one instrument string coupled to said head and passing over said bridge, said tremolo effect unit comprising a pivotable support for securing at least one instrument string under tension between said pivotable support and said head, said pivotable support being pivotably moveable relative to said bridge, lever means coupled to said pivotable support for effecting pivotable movement of said support by a performer, and resilient biasing means disposed between said pivotable support and said body to pivotably urge said support against the tension of said at least one string, said resilient biasing means extending from said support to a mounting point on said body, said mounting point being located such that said support lies between said mounting point and said head, said body being shaped to define a cavity, said cavity having a mouth opening onto said first surface, said support being in non-coupled pivotable engagement with said mouth, and said support extending through said mouth into said cavity.

2. A tremolo effect unit as claimed in claim 1 wherein said body is structured to configure said cavity with a taper adjacent to said mouth to facilitate pivotable movement of said support about said mouth.

3. A tremolo effect unit as claimed in claim 1 wherein said support includes a spacing portion located within said cavity, said spacing portion being tapered to facilitate pivotable movement of said support about said mouth.

4. A tremolo effect unit as claimed in claim 3 wherein said support includes a lip adapted for seating on said mouth, said lip having an at least partially rounded surface for pivotable engagement with said mouth.

5. A tremolo effect unit as claimed in claim 1 wherein said resilient biasing means comprises at least one compression spring disposed between said pivotable support and said body.

6. A tremolo effect unit as claimed in claim 3 wherein said support comprises a plate fixed to, and substantially perpendicularly disposed with respect to, said spacing portion of said support, said plate being dimensioned to engage against said cavity when said support is pivoted in use, thereby limiting the extent to which said support is pivotable with respect to said body.

7. A tremolo effect unit as claimed in claim 4 wherein said cavity has a hole opening onto said first surface, and said support comprises a sleeve having a lip mounted thereon, said sleeve penetrating into said cavity through said hole and said lip being seated in said mouth.

8. A stringed instrument having a body, a head, a bridge fixed to a surface of said body, and an instrument string having a first end coupled to said head and passing over said bridge, said body defining a cavity wall forming a cavity disposed such that said bridge lies between said cavity and said head, said cavity having a mouth narrower than said cavity and open to said surface, said mouth thereby defining an interior and an exterior of said cavity, said stringed instrument further including a tremolo effect unit comprising a support for securing a second end of said string above said surface such that said string passes under tension from said support, across said bridge, and to said head, said support having a portion extending through said mouth and into said cavity, said support moveably seated in said mouth to permit said support to rock back and forth in said mouth, compression spring means disposed in said interior of said cavity between said portion and said cavity wall, said compression spring means extending from said portion in a direction away from said head and disposed to exert a bias in opposition to said tension of said string to maintain said support in an equilibrium position in which said tension in said string equals said bias of said compression spring means, and lever means coupled to the support exterior to said cavity for effecting rocking movement of said support about said equilibrium position.

9. A stringed instrument as recited in claim 8 wherein said support includes a lip adapted for seating on the mouth, the lip having an at least partially rounded surface for rocking engagement with the mouth.

* * * * *